US006098865A

United States Patent [19]

Tebo

[11] Patent Number: 6,098,865

[45] Date of Patent: Aug. 8, 2000

[54] STAPLE DRIVING DEVICE

[76] Inventor: Glen J. Tebo, P.O. Box 754, Kingston, N.H. 03848

[21] Appl. No.: 09/137,012

[22] Filed: Aug. 20, 1998

[51] Int. Cl.[7] ..... B25C 1/04

[52] U.S. Cl. ..... 227/147; 227/119; 227/130; 227/134; 227/148

[58] Field of Search ..... 227/147, 148, 227/139, 134, 119, 130, 110, 149; 81/44

[56] References Cited

U.S. PATENT DOCUMENTS

| | | | |
|---|---|---|---|
| 327,537 | 10/1885 | Dodsworth | 227/139 |
| 1,074,800 | 10/1913 | King | 227/139 |
| 2,169,433 | 8/1939 | Roy | 227/147 |
| 2,199,833 | 5/1940 | Fleischman | 227/147 |
| 2,797,414 | 8/1957 | Bolster | 227/110 |
| 2,845,103 | 7/1958 | Sypher | 227/147 |
| 2,897,502 | 8/1959 | Schafroth | 227/130 |
| 2,994,878 | 8/1961 | Abrahamsen | 227/147 |
| 3,022,509 | 2/1962 | Tjark de Man | 227/147 |
| 3,112,488 | 12/1963 | Dettloff et al. | 227/147 |
| 3,542,273 | 11/1970 | Hedrick | 227/147 |
| 3,670,941 | 6/1972 | Grinnell et al. | 227/139 |
| 3,693,863 | 9/1972 | Black | 227/148 |
| 3,711,008 | 1/1973 | Clifford et al. | 227/147 |
| 3,924,790 | 12/1975 | Moeller | 227/148 |
| 4,126,258 | 11/1978 | Martin et al. | 227/148 |
| 4,907,730 | 3/1990 | Dion | 227/148 |
| 4,951,532 | 8/1990 | Nelson | 81/44 |
| 5,054,678 | 10/1991 | Nasiatka | 227/148 |
| 5,783,473 | 4/1998 | Tebo | 411/460 |

*Primary Examiner*—Peter Vo
*Assistant Examiner*—Jim Calve
*Attorney, Agent, or Firm*—Fish & Richardson P.C.

[57] ABSTRACT

A device and method for driving a first point of a double-pointed staple into a first board surface of a first board and a second point of the staple into a second board surface of a second board, the board surfaces intersecting at a junction where they define an included angle of less than 180°. The invention involves an alignment structure, having first and second abutment surfaces, a staple delivery channel, and a driver.

26 Claims, 6 Drawing Sheets

STAPLE DRIVING DEVICE

BACKGROUND OF THE INVENTION

The invention relates to an apparatus for driving staples into two boards.

Staple driving devices are used in carpentry, as well as building and construction work. In such uses, both points of a staple are driven into the same board or boards.

SUMMARY OF THE INVENTION

The invention, in general, features a device that is used to drive a first point of a double-pointed staple into a first board and a second point of a staple into a second board, near the junction of the boards, where one board is on top of the other. The device involves an alignment structure and a driver. The alignment structure has first and second abutment surfaces. The alignment structure defines a staple delivery channel that ends near the junction of the boards. The driver is slidably connected to the alignment structure. Part of the driver is capable of sliding down the staple delivery channel in the direction of the junction of the boards.

In operation, the alignment structure is positioned near the junction of the boards, so that the first abutment surface abuts the first board and the second abutment surface abuts the second board. The driver is activated so that part of the driver moves down the staple delivery channel, contacts the staple, and drives the first point of the staple into the first board and the second point of the staple into the second board.

In preferred embodiments, the device also involves an alignment plate, attached to the alignment structure. The alignment plate is spaced relative to the staple delivery channel so that the points of the staple are positioned to be driven into the first and second boards, when the alignment plate abuts a third board surface on the first board. Preferred embodiments also involve a magazine that holds a plurality of staples that successively enter the staple delivery channel. The preferred embodiments also include a handle for grasping the device, while positioning the device for use and while driving the staple.

Preferred embodiments also involve a spring to push part of the driver out of the staple delivery channel, after the staple has been driven into the boards and to return the driver to an initial position. The spring may be disposed inside the alignment structure or between the alignment structure and an end of the driver that is shaped to retain the spring. Embodiments of the invention may employ a plurality of springs to return the driver to the initial position.

Embodiments that do not employ the alignment plate may be oriented at any desired angle to a line that intersects the first surface of the first board and the second surface of the second board at the junction of the boards.

In preferred embodiments, the force required to activate the driver is supplied by using a hammer to strike the driver. Alternately, the necessary driving force may be supplied by a pneumatic device, or by an explosive device, such as a device using gunpowder.

In alternate embodiments, the force necessary to activate the driver may be supplied from an offset orientation. In these embodiments, cams, rollers, or linkages to may be used to convey force to the driver to drive the staple into the boards.

Embodiments of the invention may include one or more of the following advantages. The device may be used to drive different points of a staple into two different boards. The device may be adapted to hold a plurality of staples. The device can drive staples into two boards, at their junction, from any angle. The driving force needed to drive the staple may be supplied from an offset direction. The force needed to drive staple may be provided from a hammer strike, a pneumatic device, or an explosive device. The device facilitates the joining of boards. The device can be used with boards of wood, foam, plastic, fiberglass, or any suitable material.

Other features and advantages of the invention will be apparent from the following description of the preferred embodiments thereof and from the claims.

DESCRIPTION OF THE PREFERRED EMBODIMENTS

Figure 1:
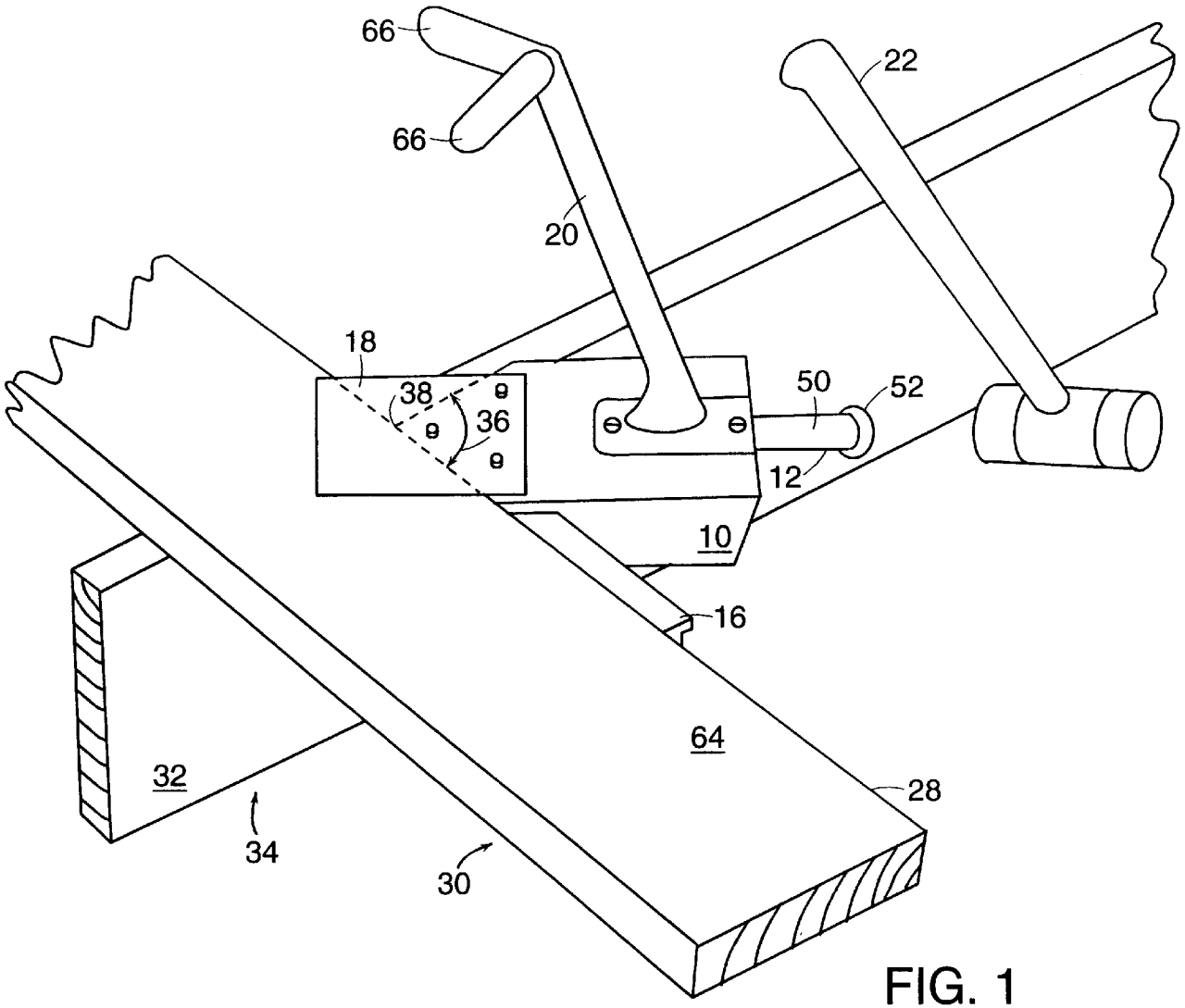
FIG. 1 is a perspective view of a staple driving device according to the invention.
Figure 2:
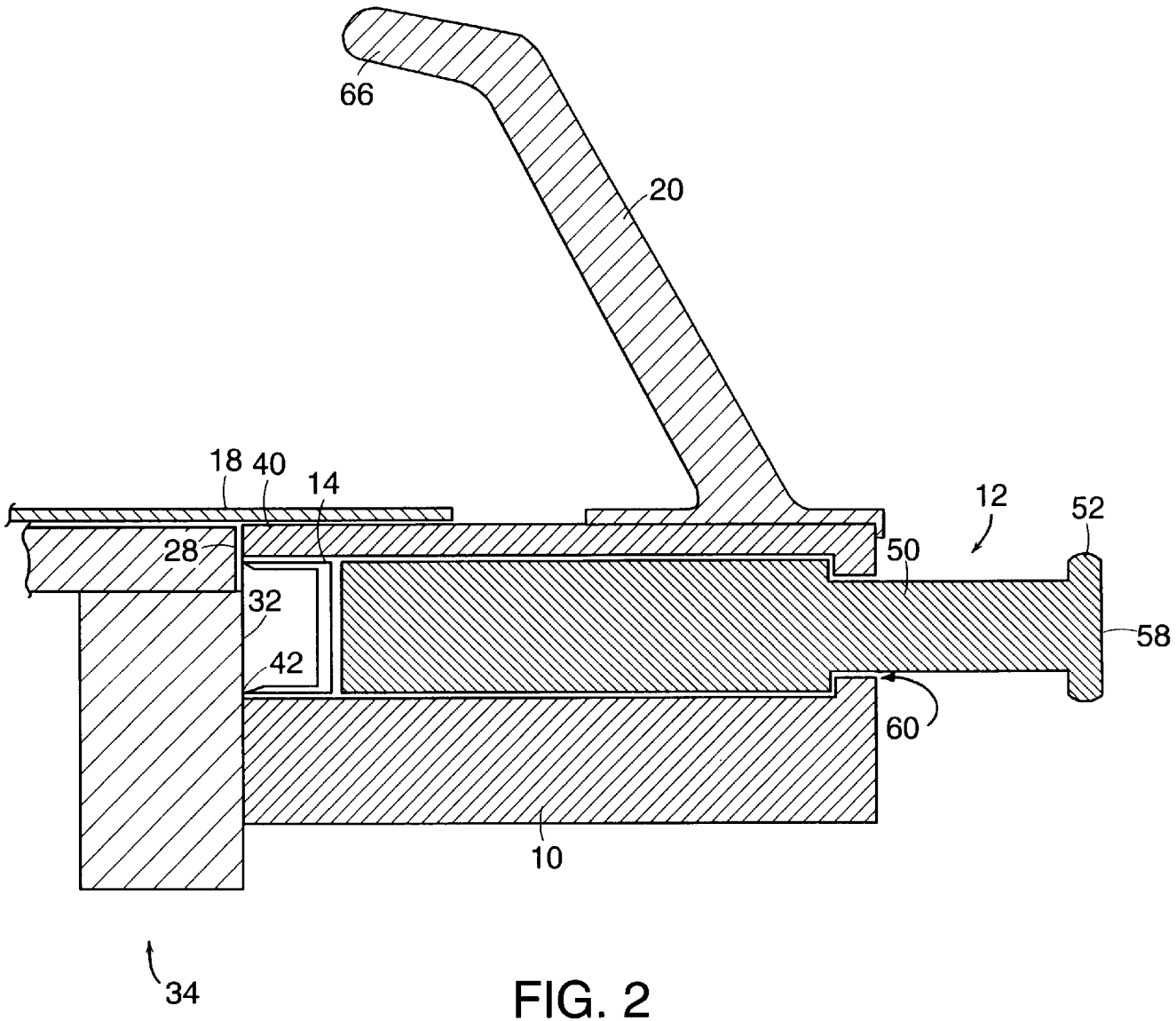
FIG. 2 is a vertical sectional view of a staple driving device according to the invention.
Figure 3:
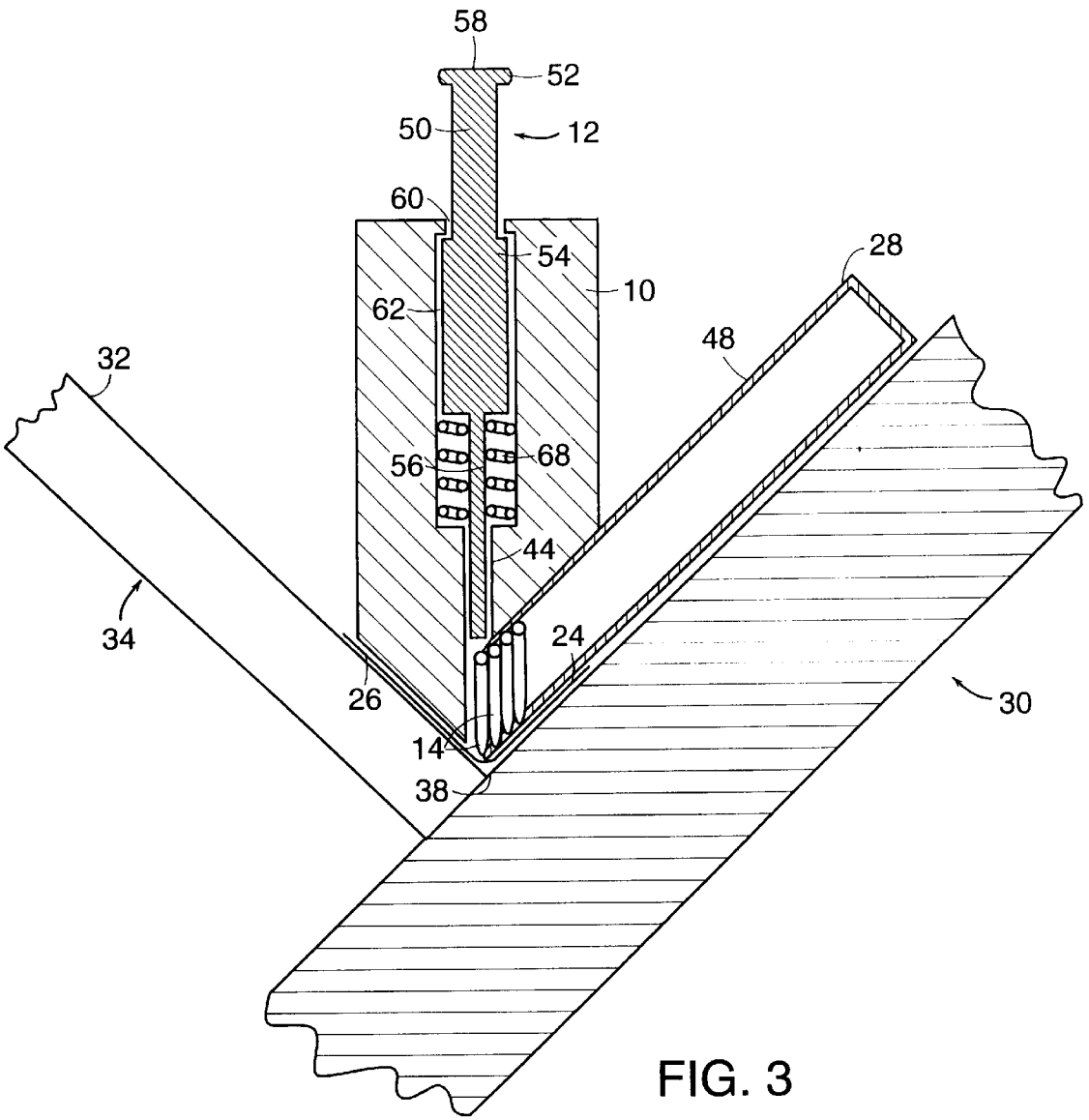
FIG. 3. is a horizontal sectional view of a staple driving device according to the invention.

Referring to FIGS. 1–3, there is shown a staple driving device employing alignment structure 10, driver 12, staples 14, magazine 16, alignment plate 18, handle 20, and hammer 22.

Alignment structure 10 has first board abutment surface 24 and second board abutment surface 26 which abut respectively first board surface 28 of first board 30 and second board surface 32 of second board 34. First board 30 is above second board 34. First board 30 and second board 34 are oriented to each other so as to form included angle 36, at junction 38 (indicated in FIG. 1), of less than 180°, e.g. approximately 90° as shown in FIGS. 1–3.

Alignment structure 10 defines staple delivery channel 44, driving channel 62, and opening 60. When abutment surfaces 24, 26 abut board surfaces 28, 32, staple delivery channel 44 is near junction 38. As seen in FIG. 2, the device is positioned to drive first point 40 of staple 14 into first board surface 28 and second point 42 of staple 14 into second board surface 32.

Magazine 16 is fitted partially within alignment structure 10. Magazine 16 defines staple supply channel 48 which joins staple delivery channel 44, so that staples 14 which are retained within staple supply channel 48 may pass into staple delivery channel 44.

Driver 12 has striking portion 50 with broadened striking head 52, stock 54, and driving portion 56. Striking head 52 projects radially from driver 12 to form striking surface 58. Driver 12 is slidably fitted within alignment structure 10. Stock 54 is sized to be capable of sliding within driving channel 62, but stock 54 is broader than opening 60. Driving portion 56 is sized to be capable of sliding within staple delivery channel 44.

Alignment plate 18 is fastened to alignment structure 10 so that it can abut third board surface 64 of first board 30.

Handle 20, having grips 66, is fastened to alignment structure 10.

Embodiments according to the invention may comprise springs biased against driver 12. The embodiment shown in FIG. 3 has two internal springs 68 disposed within driving channel 62 so that internal springs 68 are compressed between stock 54 of driver 12 and compression surface 70 that bounds driving channel 62 within alignment structure 10.

In operating the embodiment of FIGS. 1–3, a user, grasping handle 20, positions alignment structure 10 against first and second boards 30, 34. First board abutment surface 24 abuts first board surface 28; second board abutment surface 26 abuts second board surface 32; and alignment plate 18 abuts third board surface 64. Staple 14 is positioned within staple delivery channel 44 near junction 38. After alignment structure 10 is positioned, hammer 22 is made to strike striking head 52 of driver 12, thereby causing driver 12 to slide further into alignment structure 10 in the direction of junction 38. Movement of driver 12 causes driving portion 56 to slide further into staple delivery channel 44, so that driving portion 56 contacts staple 14. The movement of driver 12 also compresses internal springs 68 between stock 54 and compression surface 70. Continued progress of driver 12 pushes staple 14 further along staple delivery channel 44, thereby driving first point 40 of staple 14 into first board surface 28 and second point 42 of staple 14 into second board surface 32.

After driver 12 ceases movement down staple delivery channel 44 toward junction 38, compressed internal springs 68 expand, pushing stock 54 away from compression surface 70 and moving driver 12 away from junction 38. A compression spring (not shown), in magazine 16, then advances the next staple 14 into staple delivery channel 44.

Figure 4:
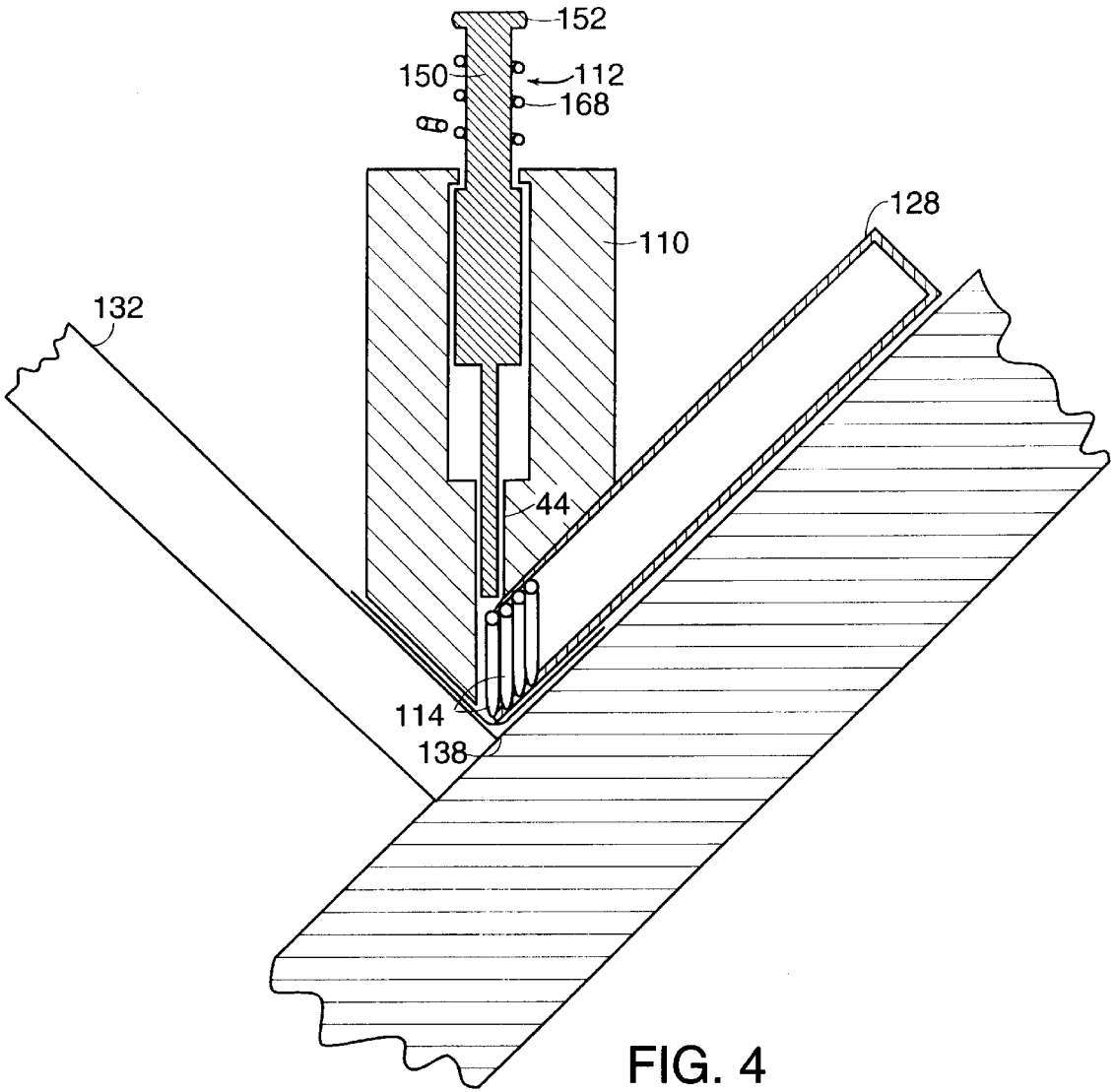
FIG. 4 is a horizontal sectional view of an alternate embodiment of a staple driving device according to the invention.

Referring to FIG. 4, in an alternate embodiment, external spring 168 is disposed between alignment structure 110 and striking head 152 on striking portion 150 of driver 112. In operation, movement of driver 112 toward junction 138 of first and second board surfaces 128, 132 compresses external spring 168 between alignment structure 110 and striking head 152. After the movement of driver 112 in the direction of junction 138 ceases, external spring 168 expands, thereby pushing striking head 152 and driver 112 away from junction 138.

Figure 5:
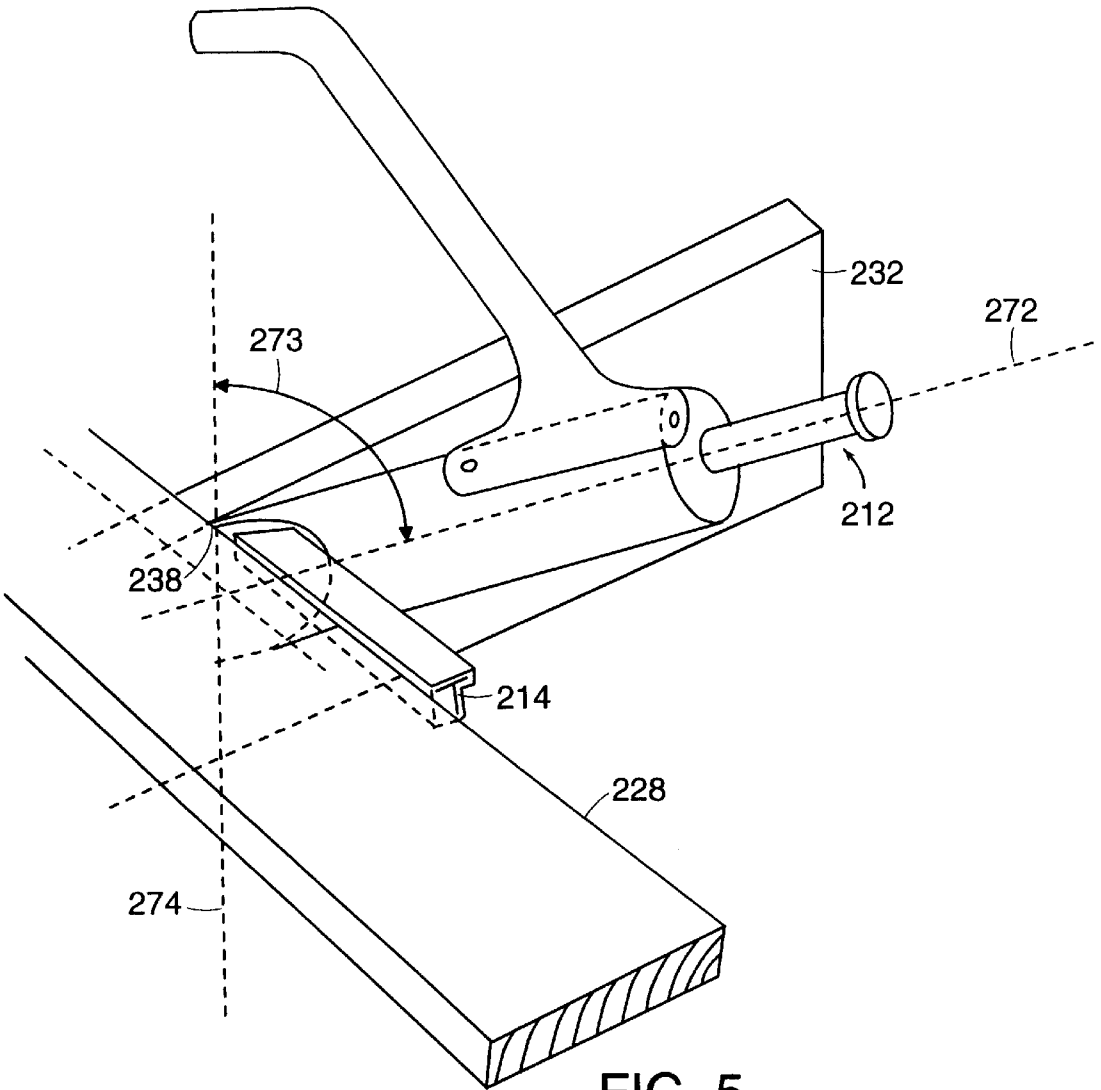
FIG. 5 is an a perspective view of an alternate embodiment of a staple driving device according to the invention.

Referring to FIG. 5, in another alternate embodiment, the device may be designed without an alignment plate. Central axis 272 is defined by the orientation of driver 212. Line 274 is at junction 238 and passes through first board surface 228 and second board surface 232. Central axis 272 of this embodiment may be oriented at any desired angle 273 relative to line 274. This embodiment employs three-pronged staples 214 of the type described in U.S. Pat. No. 5,738,473, which is incorporated herein by reference.

Embodiments of the invention may utilize any of a variety of mechanisms for delivering driving force from an offset orientation. Several such mechanisms are shown schematically in FIGS. 6A–6D.

Figure 6A:
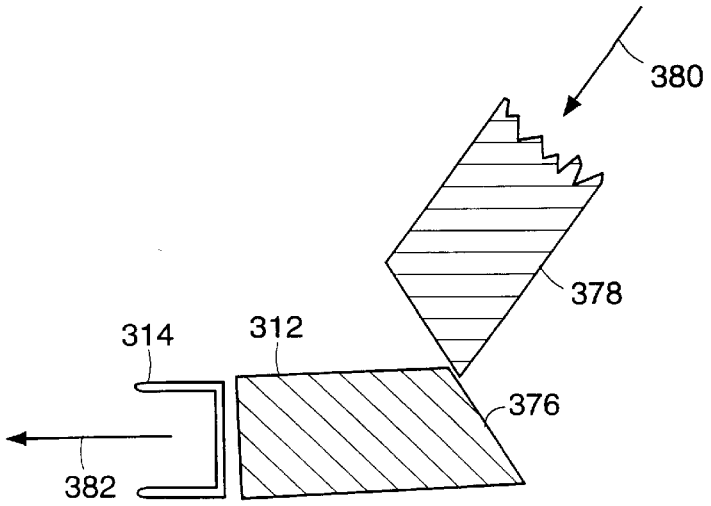
FIGS. 6A–6D are schematic drawings showing mechanisms for actuating embodiments of staple driving devices according to the invention.

The mechanism of FIG. 6A has staple 314, staple driving member 312, having sliding surface 376, and offset member 378 slidably contacting sliding surface 376. When offset member 378 is moved toward driving member 312, in offset direction 380, offset member 378 slides relative to sliding surface 376 and driving member 312 pushes against staple 314 and drives it in driving direction 382.

Figure 6B:
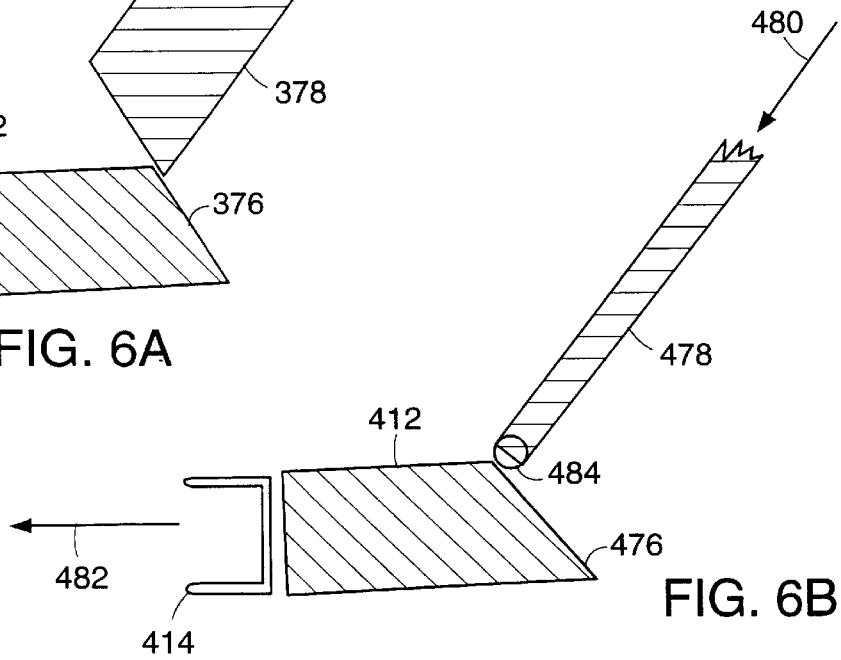

The mechanism of FIG. 6B has staple 414, staple driving member 412, having roller surface 476, and offset member 478 with roller 484. When offset member 478 is moved toward driving member 412, in offset direction 480, roller 484 rolls along roller surface 476 and driving member 412 drives staple 414 in driving direction 482.

Figure 6C:
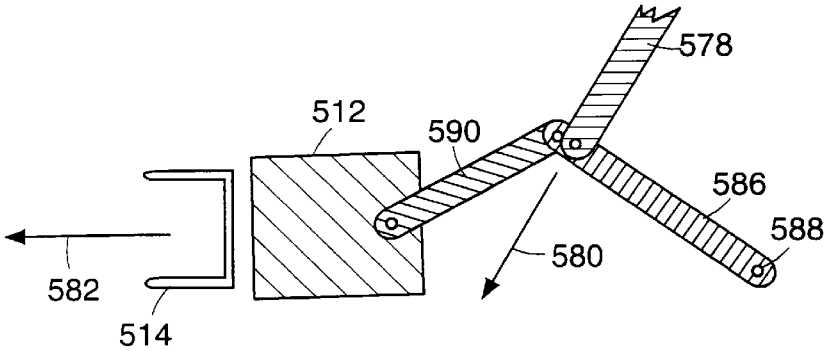

The mechanism of FIG. 6C has staple 514, staple driving member 512 and offset member 578. Offset member 578 is pivotally connected to first linkage member 586. First linkage member 586 is pivotally connected to a structure (not shown) at fixed point 588 and is pivotally connected to second linkage member 590. Second linkage member 590 is pivotally connected to driving member 512. When offset member 578 is moved in offset direction 580, second linkage member 590 pushes driving member 512, causing driving member 512 to drive staple 514 in driving direction 582.

Figure 6D:
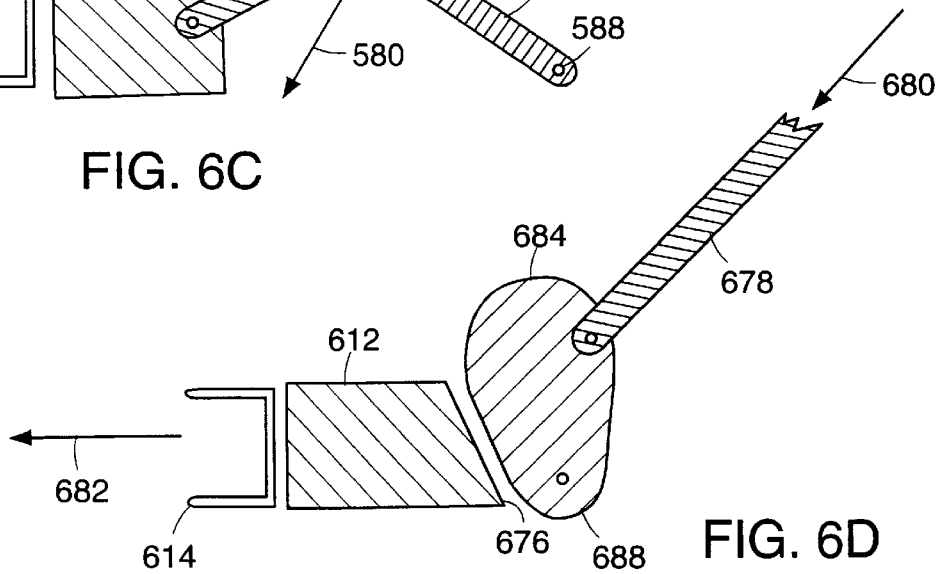

The mechanism of FIG. 6D has staple 614, staple driving member 612 having camming surface 676, and offset member 678. Offset member 678 is pivotally connected to cam 684. Cam 684 is pivotally connected to a structure (not shown) at fixed point 688 and slidably contacts camming surface 676. When offset member 678 is moved in offset direction 680, cam 684 pushes against staple driving member 612 and slides relative to camming surface 676, causing driving member 612 to drive staple 614 in driving direction 682.

Other embodiments of the invention are within the scope of the claims. For example, in place of hammer 22, a pneumatic actuator could be connected to driver 12, in order to provide driving force relative to structure 10. Alternately, an explosive actuator could be used to provide the same relative driving force.

What is claimed is:

1. Staple driving device for driving one point of a double-point staple into a first board surface of a first board and another point into a second board surface of a second board at a junction of said first and second boards, said first board overlying said second board, the first and second surfaces making a first included angle of less than 180° between them, the device comprising:

alignment structure having first and second board abutment surfaces in respective planes at said first included angle, said planes intersecting at a line to be aligned with said junction in use;

a staple supply channel, a plurality of U-shaped double-point staples in said staple supply channel, each said staple having a first leg and point, a second leg and point parallel to the first leg and point, and a connecting portion that is perpendicular to said first and second legs and points, said first and second points being generally aligned with said line, and said connecting portion being parallel to said line, said staple supply channel ending at a staple delivery channel at said line aligned with the junction of said first and second abutment surfaces so as to direct a first point of said first staple into said first board and a second point of said first staple into said second board, said delivery channel fixed in position with respect to said alignment structure;

a driver for driving said first staple from said staple delivery channel through said line into said boards, said driver being slidably connected to said alignment structure; and an alignment plate fastened to the alignment structure to form an abutment surface perpendicular to said line.

2. The device of claim 1 wherein said first abutment surface abuts the first board surface.

3. The device of claim 2 wherein said second abutment surface abuts the second board surface.

4. The device of claim 1, further comprising a handle attached to said alignment structure.

5. The device of claim 1 wherein said driver has a striking portion and driving portion.

6. The device of claim 1 wherein at least part of said driver is disposed within said alignment structure.

7. The device of claim 1, wherein said alignment plate is capable of abutting a third board surface of the first board, and spaced relative to said staple delivery channel, so that said first point of said staple is positioned to be driven into the first board surface and said second point of said staple is positioned to be driven into the second board surface.

8. The device of claim 1, further comprising a hammer for delivering force to said driver.

9. The device of claim 1, further comprising a pneumatic pressure apparatus for delivering force to said driver.

10. The device of claim 1, further comprising an explosive apparatus for delivering force to said driver.

11. The device of claim 1, further comprising a handle.

12. The device of claim 1, further comprising a magazine, connected to said alignment structure, for retaining a plurality of staples.

13. The device of claim 1, further comprising an offset member for delivering force to said driver from an offset position.

14. The device of claim 13, further comprising a roller for conveying force from said offset member to said driver, said roller being rotatably connected to said offset member and capable of rolling against said driver.

15. The device of claim 13, further comprising a linkage mechanism for conveying force from said offset member to said driver.

16. The device of claim 13, further comprising a cam for conveying force from said offset member to said driver.

17. The device of claim 1, further comprising at least one return spring connected between said alignment structure and said driver.

18. The device of claim 17 wherein said at least one spring is inside said alignment structure.

19. The device of claim 17 wherein said at least one spring is outside said alignment structure.

20. A method for driving a double-pointed staple comprising:

positioning a first board surface and a second board surface such that said first and second surfaces intersect at a junction of said first and second board surfaces, one said board surface overlying the other said board surface, said board surfaces making a first included angle of less than 180° between them;

providing a staple driving device having an alignment structure with first and second board abutment surfaces in respective planes near said junction, said planes intersecting at a line aligned with said junction; a staple supply channel, containing a plurality of U-shaped double-point staples in said supply channel, each said staple having a first leg and point, a second leg and point parallel to the first leg and point, and a connecting portion that is perpendicular to said first and second legs and points, a first said staple having said first and second points generally aligned with said line and said connecting portion parallel to said line, said channel having an end at a staple delivery channel at said line, said delivery channel being fixed in position with respect to said alignment structure; and a driver for driving said first staple from said channel through said line into said boards, said driver being slidably connected to said alignment structure;

positioning said device near said junction, so that said first abutment surface abuts said first board surface and said second abutment surface abuts said second board surface, and so that said line and connecting portion are aligned with said junction and a first point of said staple is directed toward said first board and a second point of said staple is directed toward said second board, and said end of staple delivery channel is near said junction;

driving said driver from an initial position to a final position, thereby causing part of said driver to progress down said staple delivery channel until said first point of said staple has been driven through said line into said first board surface and said second point of said staple has been driven through said line into said second board surface.

21. The method of claim 20 wherein said driving step is performed by striking said driver with a hammer.

22. The method of claim 20 wherein said driving step is performed by activating said driver with a pneumatic device.

23. The method of claim 20 wherein said driving step is performed by activating said driver with an explosive device.

24. The method of claim 23 wherein said explosive device employs gunpowder.

25. The method of claim 20, further comprising the step of returning said driver to said initial position.

26. The method of claim 25 wherein said returning step is performed by the relaxation of at least one spring that is compressed during said driving step.

* * * * *